US006652965B2

(12) United States Patent
Merigold et al.

(10) Patent No.: US 6,652,965 B2
(45) Date of Patent: Nov. 25, 2003

(54) MELT SPUN YARNS HAVING HIGH LUSTER

(75) Inventors: Richard J. Merigold, Upton St. Leonards (GB); Michael G. Harriss, Cheltenham (GB); Peter S. O'Donnell, Gloucestershire (GB); David J. Marfell, Gloucestershire (GB)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/099,175

(22) Filed: Mar. 13, 2002

(65) Prior Publication Data

US 2003/0054168 A1 Mar. 20, 2003

(51) Int. Cl.[7] ..... D01F 6/00
(52) U.S. Cl. ..... 428/364; 428/395
(58) Field of Search ..... 428/364, 395

(56) References Cited

U.S. PATENT DOCUMENTS

| | | | |
|---|---|---|---|
| 2,939,201 | A | 6/1960 | Holland |
| 2,939,202 | A | 6/1960 | Holland |
| 3,508,390 | A | 4/1970 | Bagnall et al. |
| 4,492,731 | A | 1/1985 | Bankar et al. |
| 5,164,261 | A | 11/1992 | Windley |
| 5,391,703 | A | 2/1995 | Lin |

FOREIGN PATENT DOCUMENTS

| | | | |
|---|---|---|---|
| EP | 0373655 | A1 | 6/1990 |
| EP | 0517203 | A2 | 12/1992 |
| GB | 401160 | | 11/1933 |
| JP | 1292194 | A | 11/1989 |
| JP | H1-292194 | A | 11/1989 |
| JP | 04152028 | A | 12/1993 |
| JP | H5-338069 | A | 12/1993 |
| JP | 10251945 | A | 9/1998 |
| WO | WO 9501469 | A1 | 1/1995 |
| WO | WO 9850610 | A1 | 11/1998 |
| WO | WO 9914407 | A1 | 3/1999 |
| WO | WO 9946436 | A1 | 9/1999 |

OTHER PUBLICATIONS

Patent Abstracts of Japan, vol. 1998, No. 14, Dec. 31, 1998.

*Primary Examiner*—N. Edwards

(57) ABSTRACT

The invention provides a profiled polyamide yarn having a yarn weight of from 5 to 300 dtex a filament weight of from 0.5–7 dtex and a non-circular profiled filament cross-section, wherein the polyamide comprises from 0.01 to 3% by weight of a non-white pigment melt dispersed therein. The yarns have a high, metallic lustre due to the combined effect of profiling and the non-white pigment. The invention also provides textile fabrics comprising the yarns, and garments comprising the said fabrics. The invention also provides methods of making the inventive yarns by spinning a polyamide melt having the non-white pigment dispersed therein.

25 Claims, 1 Drawing Sheet modification ratio = $R_2/R_1$ aspect ratio = A/B modification ratio = $R_2/R_1$ aspect ratio = A/B

MELT SPUN YARNS HAVING HIGH LUSTER

CROSS-REFERENCE TO RELATED APPLICATION

This application claims benefit of priority from application number 0106300.7 filed Mar. 14, 2001 in Great Britain.

FIELD OF THE INVENTION

The present invention relates to melt spun yarns having a highly lustrous "metallic" appearance, and to fabrics and garments incorporating such yarns. The present invention also relates to methods of manufacture of such melt spun yarns and fabrics.

BACKGROUND OF THE INVENTION

Filaments and yarns of metals such as silver and gold have been known and valued for their appearance since antiquity, and real gold or silver thread is still used in garments. More recently, copper thread has been incorporated into, for example, men's jackets, for perceived health benefits.

Fabrics of woven metal filaments and yarns have also been used to make filter elements, and as conductive cloths to confer electromagnetic shielding properties.

It is also known to use metallised polymer filaments to provide the appearance of a metallic yarn, for example, LUREX® yarns. Such yarns are typically manufactured by bonding a thin layer of aluminium on to a plastic film, and then cutting the film into very fine strips to make a thread. By incorporating appropriate colours, the yarn can be given the appearance of silver, gold, etc. However, such yarns are relatively coarse and scratchy, and are limited in use to a surface effect. They would be extremely uncomfortable worn next to the skin. Furthermore, the production process is expensive.

It would be highly desirable to produce a yarn of bright metallic appearance suitable for use in textile applications, especially for apparel, and having the feel and other properties of a soft, conventional textile yarn. It would be especially desirable if the yarn could be produced on existing yarn manufacturing equipment at little additional cost relative to conventional yarns.

Since such a yarn is likely to be used as a highlight in the fabric, it is also desirable that the metallic colour should be an inherent property of the as-spun yarn rather than a result of subsequent coating or dyeing of the yarn. This would help to ensure that the metallic-lustre yarn does not stain the other yarns present in the fabric, and also makes it possible for the yarn with metallic lustre not to be affected by the dyeing process used for the remainder of the fabric.

In order to obtain a metallic effect yarn which is visibly distinct from the rest of the fabric, it is desirable that the yarn be coloured before processing into fabric. While it is theoretically possible to dye yarns by conventional means, so-called "package dye yarns", this process is normally restricted to textured yarns which have a structure open enough to permit flow of the dye liquor through the bobbin. Dyeing of the much denser packages obtained with flat yarns is technically difficult, and also expensive, especially at low decitex.

These problems can be solved by the incorporation of pigments and/or dyestuffs into a molten polymer, followed by melt-spinning the polymer into a yarn. Processes of this kind are described in U.S. Pat. Nos. 5,164,261 and 5,391,703. The colourant may be added as a masterbatch, by blending of polymer granules, or by direct injection of the colourant-carrying liquid into an extruder as described in PCT patent document number WO99/14407.

The yarns so produced find particular use as carpet yarns, which are typically of about 1400 decitex with individual filaments about 7 to 20 decitex, and so are much coarser than apparel yarns, which run from about 5 to 300 decitex with individual filaments typically from below 1.0 to around 6 decitex.

It is also known that nylon yarns, which are normally strongly dyed by anionic dyestuffs, can be rendered resistant to such dyestuffs by the incorporation of sulfonate groups within the polymer, as described in U.S. Pat. No. 5,164,261. Such yarns are often referred to as base-dye, cationic-dye, or simply cat-dye yarns, because the chemical group that is responsible for anionic dye resistance also confers cationic dyeable properties on the yarn. Cationic dyes are rarely used in apparel yarns however, and it is the anionic-dye resistance which is of especial interest for the present invention.

SUMMARY OF THE INVENTION

It has been found by the present inventors that textile yarns having the metallic colour and lustre and other desirable properties described above can be made by incorporating a pigment into a molten polymer, followed by melt-spinning to give a yarn of a selected cross-section. The yarns are of soft hand and are comfortable to wear as a garment. It has further been found that the metallic effect is yet further enhanced when the metallic yarn is combined in a fabric with dark coloured companion yarn, especially a black yarn, which serves to emphasise the metallic highlights.

Further enhancement of the metallic effect is achieved by selecting companion yarns of higher anionic dye affinity, especially polyamide yarns with Amine End Group (AEG) levels higher than 60 equivalents per $10^6$ g. The anionic dye then tends to be retained on the companion yarn, and anionic staining of the melt coloured yarn is minimised.

In other words, colour differentiation is maximised and cross-staining minimised by using a polymer for the 'metallic yarn' which is anionic-dye resistant, while that of the companion yarn is specifically attractive to anionic dyes. The use of high affinity companion yarns also enables the use of high pH dyeing techniques to increase the stain blocking effect.

Specifically, the present invention provides a profiled polyamide yarn having a yarn weight of from about 5 to about 300 dtex, a filament weight of from about 0.5 to about 7 dtex, and a non-circular profiled filament cross-section, wherein the polyamide comprises from about 0.01 to about 3% of a non-white pigment melt-dispersed therein.

DETAILED DESCRIPTION OF THE PREFERRED EMBODIMENTS

The yarn of the present invention is a relatively low weight yarn that is especially useful for apparel fabric applications. Preferably, the yarn comprises from about 3 to about 136 filaments each having a filament weight of from about 0.5 to about 7 dtex.

The yarn is preferably a partially oriented yarn (POY) which may either be used directly, or subsequently processed via a flat drawing or a texturising route. Preferably, it may also be a fully drawn yarn (FDY). However, it may also be a drawn yarn derived from a low oriented yarn (LOY) which has subsequently been processed further, on for example a draw-twist or draw-wind machine.

Preferably, the yarn has a filament uniformity in Uster% of about 1.5% or less, more preferably about 1% or less. This is desirable in order for the yarn to have the high appearance uniformity needed for apparel applications, and also to reduce yarn breaks in texturing, weaving and knitting operations.

Preferably, the yarn has an elongation to break of from about 20 to about 90%. Preferably, the yarn has a tenacity of from about 25 to about 65 cN/tex. These tensile properties are all desirable for apparel textile applications.

The yarns according to the present invention are profiled. That is to say, the cross-section of at least one of the filaments in the yarns according to the present invention is not circular, and preferably substantially all of the filaments have non-circular cross-sections.

Figure 1A:
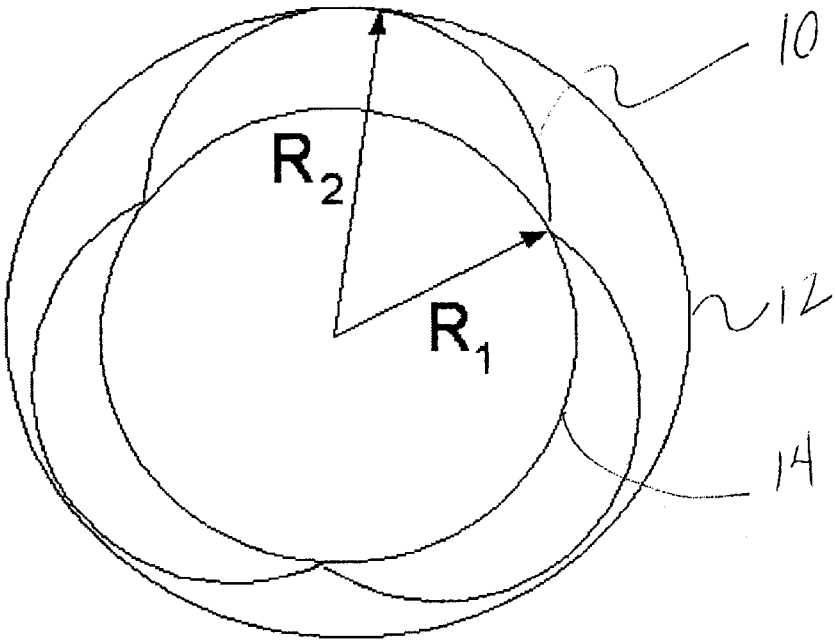
FIG. 1A is a cross-sectional view of a trilobal fiber, illustrating how the modification ratio of the fiber is measured.

In certain embodiments the filament cross-section is trilobal. Such a filament cross-section is illustrated at 10 in FIG. 1A. Preferably, the trilobal filament modification ratio is in the range of from about 1.2 to about 2.4, and preferably in the range from about 1.4 to about 1.8. The modification ratio is defined as the ratio of the radius, $R_2$, of the smallest circle 12 that circumscribes the profile to the radius, $R_1$, of the largest circle 14 that is completely inscribed in the profile. FIG. 1A makes it clear how this measurement is made.

Figure 1B:
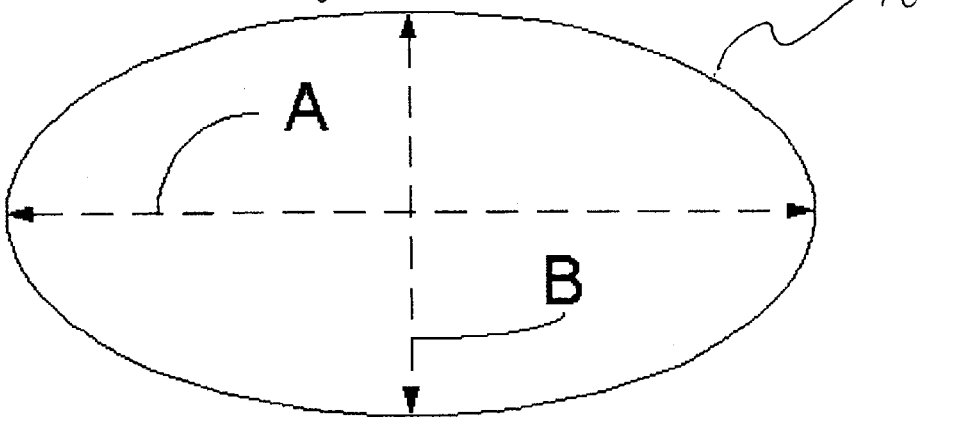
FIG. 1B is a cross-sectional view of a fiber having a two-fold axis of symmetry, illustrating how the aspect ratio of the fiber is measured.

In other embodiments, the filament cross-section is elongated. Such a filament cross-section is illustrated at 10' in FIG. 1B. Preferably, the cross-section has a two-fold axis of rotational symmetry. For example, the filament cross-section may be selected from the group consisting of oval, tape or diabolo shapes. Preferably, the length ratio (Aspect Ratio) of the longest axis of the elongated filament cross-section (length 'A' in FIG. 1B) to the shortest axis at right angles to that longest axis (length 'B' in FIG. 1B) is greater than about 1.5.

Although the shapes above have been chosen to exemplify the invention, the invention is not confined to these specific examples, but rather comprises all non-circular profiles. Such shapes might include 'clover-leaf', cruciform, T-shape, 'wavy tape' and so on. It is not possible to list them exhaustively.

By non-white pigment is meant a coloured organic or inorganic substance that is preferably insoluble in water but may be only sparingly soluble in water. Preferably, the non-white pigment has sufficiently high heat stability for melt spinning. The non-white pigment is present in an amount of from about 0.01 to about 3% by weight of the filaments, preferably from about 0.02 to about 2% by weight. The pigment is melt-dispersed in the polyamide. That is to say, it is distributed uniformly in the polyamide as a result of having been dispersed in molten polyamide prior to extruding the molten filaments.

The pigment may be insoluble in the polymer, or it may be a so-called disperse pigment or disperse dyestuff that is soluble in the polymer but is substantially insoluble in water. The pigment composition for a desired appearance is identified by routine trial of commercially available polyamide spinning pigments, and is not limited to the commercial pigments exemplified herein.

Silvery looking metallic yarns may comprise a carbon black pigment. Golden and copper-coloured metallic yarns may comprise a mixture of black, yellow and optionally also red pigments.

The metallic effect is most readily perceived when the yarn is bright and lustrous, so the polymer should be essentially free of delustering agents. Preferably therefore, the polyamide yarns according to the present invention comprise less than about 0.1% by weight of $TiO_2$, more preferably less than about 0.05%, and most preferably less than about 0.03%.

Preferably, the yarn according to the present invention has an enhanced lustre giving a metallic appearance. The metallic appearance is the result of a combination of colour and yarn cross-section, with the diabolo cross-section particularly imparting the lustre.

The polyamide yarn according to the present invention will most often be flat (not textured) but could also be textured, for example by a low-bulk false-twist route, or by air-jet texturing.

Preferably, the polyamide comprises a cationic dyeable polyamide, and more preferably it consists essentially of a cationic dyeable polyamide. This enables especially decorative effects to be achieved by producing fabrics from the yarn according to the present invention with a second yarn that is not a cationic dyeable polyamide, followed by selectively dyeing the second yarn with an anionic dye.

In a second aspect, the present invention provides a fabric comprising a profiled polyamide yarn according to the present invention.

The fabric may be knitted, woven or nonwoven, but preferably it is knitted.

In certain preferred embodiments, the fabric further comprises a second yarn having a less reflective (i.e., metallic) appearance than the profiled yarn, whereby the profiled yarn produces highlights in the fabric. These highlights are especially marked if the second yarn is dyed dark or black.

In certain preferred embodiments the profiled yarn is a cationic dyeable polyamide yarn and the second yarn is dyed with an anionic dye, as described above. This enables fabric that is produced from these yarns to be selectively dyed by means of an anionic dye, instead of having to dye the second yarn before producing the fabric.

Preferably, further enhancement of the metallic effect is achieved by the second yarn being a yarn of a higher anionic dye affinity (AEG>60), in order to minimise colour stain on the spun coloured yarn. The use of high affinity companion yarns also enables the use of high pH dyeing techniques to increase the stain blocking effect.

In a third aspect, the present invention provides a garment comprising a fabric according to the present invention. Preferably, the garment has the fabric on an outside surface of the garment where it is visible.

In a fourth aspect, the present invention provides a process for the production of a profiled polyamide yarn comprising the steps of: providing a molten polyamide having a non-white pigment dispersed therein, extruding the molten polyamide through a plurality of profiled non-circular orifices to form a yarn, and winding up the yarn. In the spinning process, the yarns are oiled, and optionally may be interlaced.

Preferably, the resulting yarns are textile yarns, for example yarns that have an individual filament weight equal to or less than 7 dtex. Preferably, the winding up is carried out at a speed greater than 3000 m/min, more preferably at a speed of at least 3500 m/min.

In certain embodiments the yarn is wound up at a speed sufficient to produce a partially oriented yarn (POY). The method may include a drawing step before the wind-up to produce a partly drawn or fully (FDY) drawn yarn. In other embodiments the textile yarn may be a low orientation yarn (LOY).

Preferably, the process according to the present invention is suitable for the production of a profiled yarn according to the invention.

Test Methods

Specific embodiments of the present invention will now be described further, by way of example. In the following examples, the yarn properties were measured as follows:

- Yarn & polymer relative viscosity were measured using 8.4% w/w solution in formic acid. The instrument used was an automated viscometer of the timed-flow, U-tube type.
- Yarn Decitex (the linear density) was measured using a wrap-wheel & weighing balance, according to the BISFA "Internationally agreed methods for testing polyamide filament yarns"—1995.
- Yarn linear density evenness, also known as the yarn Uster percent (U%), was determined using a Uster eveness tester 3, type C.

The oil on yarn percentage was determined using a Bruker NMR (Nuclear Magnetic Resonance) minispec pc-120 instrument Calibration was made against known standards where oil level had been measured by extracting oil from the yarn by hot petroleum ether, evaporating, and weighing the residue.

Yarn tensile properties (breaking force, tenacity, percentage extension to break and the derived parameter T*RE where T is the tenacity which is multiplied by RE, the square root of the extension to break) were measured on an Instron Tensile Tester model 4301 using conditions stated in the BISFA "Internationally agreed methods for testing polyamide filament yarns"—1995.

Boiling water shrinkage was measured according to BISFA "Internationally agreed methods for testing polyamide filament yarns"—1995.

EXAMPLES

Example 1

In order to establish the optimum cross-section for a metallic silver look, a range of profiled polyamide yarns according to the invention was spun. The general spinning processes are described below, and specific conditions are listed in Table 2.

In general, granules of a nylon 66 polymer of known relative viscosity (RV) and chemical composition were blended with granules of a masterbatch polymer containing the desired pigment, in an amount calculated to give a predetermined amount of pigment in the yarn. In the specific case of the black and silver yarns, a typical masterbatch (supplied by Americhem Inc. of Cuyahoga Falls, Ohio USA) consisted of a 5% dispersion of carbon black in a polyamide matrix. Since this concentration was rather too high to provide the lowest concentrations needed in the yarn, the masterbatch was itself mixed 50/50 with granules of the polymer to be spun by rolling the two together in a drum, and this mixture, effectively now diluted to a carbon-black concentration of only 2.5%, was used as a secondary masterbatch that was metered into the main polymer supply.

In the case of a "gold" yarn, a typical recipe comprises three separate pigment masterbatches that we mixed together in the proportions that gave the "best looking" gold . The recipe is as follows: 0.12% Yellow 2016+0.1% Red 3030+0.0084% C-black. The Yellow 2016 masterbatch is a 20% concentration masterbatch i.e. 20% pigment/80% polyamide. The Red 3030 is a 30% concentration masterbatch and the C-black is a 5% concentration masterbatch. The yellow and red are masterbatches from Magenta Master Fibers, Via Alessandrini, 42/56, 20013 Magenta, Italy and the C-black is from Americhem as above, or from Magenta.

It is thought that a "copper" yarn can be obtained by adding further red pigment to compositions similar to those above.

Type and properties of the polymers used are given in Table 1.

TABLE 1

| Polymer Code | RV (Formic Acid) | Amine ends Eq. Per $10^6$ g | Sulfonate ends Eq. Per $10^6$ g |
|---|---|---|---|
| Standard, anionic dyeable polymer | 40 | 50 | — |
| Cationic dyeable polymer (anionic dye resist | 31.5 | 41 | 55 |

The mixed polymer granules were then fed to a melting device, and the resulting molten polymer was forwarded by a metering pump to a filter pack, and then extruded through a spinneret plate containing capillary orifices of a shape designed to yield the desired yarn cross-section at the expected spinning temperature. Such cross-sections included round, circular, trilobal, diabolo and tape, which are further characterised below. Spinneret temperature was 276–280° C.

The emerging bundle of molten filaments was cooled by a stream of quench air, treated with spin finish (generally an oil/water emulsion), optionally interlaced, further processed in-line on the spinning machine (see paragraph below), and then wound on to bobbins.

In the specific case of FDY (Fully Drawn Yarn), the in-line processing on the spinning machine comprised making several turns round a set of godet rolls (feed rolls), the number of turns being sufficient to prevent slippage over these rolls, then passing the yarn over another set of rolls (draw rolls) revolving at sufficient speed to stretch the yarn by a predetermined amount (the draw ratio), and finally heat setting the yarn with a steam-box, before winding up at a speeds of 3800 m/min (in one case, 4200 m/min. For fuller details see Table 2). Optionally, an alternative setting method could have been used, such as heated rolls, and an additional set of godet rolls may be incorporated between draw rolls and winder to control the tension while the yarn is set or relaxed. Optionally also a second application of spin finish, and/or additional interlacing may be applied before the final winding step.

In the specific case of POY (Partially Oriented Yarn), the additional in-line processing comprised making a S-wrap over two Godet rolls revolving at the same speed, and then passing the yarn to a high speed winder, in this case running at 3800 m/min . Use of the S-wrap is beneficial in order to control tension, but not essential. The POY yarn may be used directly as a flat yarn for knitting or weaving, or be used as a feedstock for texturing.

In the case of LOY yarns, the experimental procedure is very similar to POY, except that a windup speed of 1000 m/min or below is used, and the yarns produced require further processing as a second stage e.g. on a conventional draw-twist or draw-wind machine. The exact spinning conditions are given in Table 2:

TABLE 2

| Sample Number | Yarn Dtex | Filaments in Yarn | Yarn Type | Cross Section | % C-black | Wind-up Speed m/min | Draw Ratio | Relax Ratio |
|---|---|---|---|---|---|---|---|---|
| A | 96 | 26 | POY | diabolo | 0 | 3800 | 1:1 | 1:1 |
| B | 96 | 26 | POY | diabolo | 0.025 | 3800 | 1:1 | 1:1 |
| C | 96 | 26 | FDY | diabolo | 0.025 | 3800 | 2:1 | 1.07:1 |
| D | 96 | 26 | POY | diabolo | 0.05 | 3800 | 1:1 | 1:1 |
| E | 96 | 26 | POY | diabolo | 0.075 | 3800 | 1:1 | 1:1 |
| F | 96 | 26 | POY | trilobal | 0 | 3800 | 1:1 | 1:1 |
| G | 96 | 26 | POY | trilobal | 0.025 | 3800 | 1:1 | 1:1 |
| H | 96 | 26 | FDY | trilobal | 0.025 | 3800 | 2:1 | 1.0625:1 |
| I | 96 | 26 | POY | trilobal | 0.05 | 3800 | 1:1 | 1:1 |
| J | 96 | 26 | POY | trilobal | 0.075 | 3800 | 1:1 | 1:1 |
| K | 96 | 26 | POY | circular | 0 | 3800 | 1:1 | 1:1 |
| L | 96 | 26 | POY | circular | 0.025 | 3800 | 1:1 | 1:1 |
| M | 96 | 26 | FDY | circular | 0.025 | 3800 | 2:1 | 1.0625:1 |
| N | 96 | 26 | POY | circular | 0.05 | 3800 | 1:1 | 1:1 |
| O | 96 | 26 | POY | circular | 0.075 | 3800 | 1:1 | 1:1 |
| P | 56 | 24 | FDY | tape | 0.025 | 4200 | 1.5:1 | 1.055:1 |

These experiments (Examples 1A to 1P) were designed to establish a) the optimum cross section for a metallic silver look in a yarn of 26 filaments with a decitex of 96; also, b) the most appropriate concentration of carbon black to incorporate in the polymer, and additionally c) whether there was any substantial difference in appearance between POY and FDY yarns.

Accordingly, all yarns were made with standard, anionic-dyeable nylon polymer, since this was initially more convenient than the dye-resist polymer and does not affect the appearance or handle of the yarns. Results are shown in Table 3.

TABLE 3

| Yarn * | Breaking Force % Exten. | Tenacity (cN per dtex) | T*RE | U % | Boiling water Shrinkage % |
|---|---|---|---|---|---|
| A | 3.52<br>63.57 | 36.05 | 287.4 | 0.71 | 4.6 |
| B | 3.44<br>64.46 | 35.26 | 283.1 | 0.75 | 4.8 |
| C | 4.16<br>50.42 | 42.07 | 298.5 | 0.76 | 8.8 |
| D | 3.38<br>62.01 | 34.48 | 271.5 | 0.74 | 5.5 |
| E | 3.27<br>62.69 | 33.51 | 265.4 | 0.74 | 5.3 |
| F | 3.29<br>54.35 | 33.21 | 244.9 | 0.79 | 5.6 |
| G | 3.23<br>59.50 | 32.65 | 251.9 | 0.85 | 4.6 |
| H | 3.90<br>44.80 | 39.32 | 262.9 | 0.83 | 8.2 |
| I | 3.15<br>59.80 | 31.78 | 245.7 | 0.98 | 4.8 |
| J | 3.08<br>60.09 | 30.94 | 239.9 | 1.01 | 4.9 |
| K | 3.79<br>67.44 | 38.30 | 314.6 | 0.77 | 4.7 |
| L | 3.75<br>69.77 | 37.96 | 317.1 | 0.77 | 4.5 |
| M | 3.88<br>47.95 | 38.86 | 269.4 | 0.79 | 7.6 |
| N | 3.57<br>68.18 | 36.10 | 298.1 | 0.88 | 4.6 |
| O | 3.57<br>68.72 | 36.04 | 298.8 | 0.86 | 4.6 |
| P | 1.67<br>32.25 | 29.90 | 169.9 | 1.04 | 7.8 |

* yarns had an oil on yarn level in the range 0.5 to 0.8% (w/w)

This Table 3 shows a set of similar yarns made in circular, trilobal and diabolo cross sections as described in Table 2. Each set of POY yarns was made at a carbon black concentration of 0, 0.025, 0.050, and 0.075 wt. % carbon. The experiment at 0.025% carbon was repeated for a fully drawn yarn at a draw ratio of 2:1. A yarn with a tape cross-section (1.5:1 draw ratio) was also spun in a separate experiment and the data obtained is also given in Table 3. Yarns were knitted into panels as described above, and assessed by a combined team of technical and marketing experts. The clear trends were as follows:

1. The circular cross-section yarns give an uninteresting fabric, lacking any resemblance to a metallic yarn;
2. The trilobal cross-section yarns give a fabric of bright, speckled, grainy appearance, perhaps reminiscent of etched steel.
3. The diabolo cross-section yarns give a silvery lustre with a soft sheen. This is believed to be due to the specular reflection from the long side of the filament cross section, as well as the fact that diabolo filaments tend to align themselves in a parallel fashion, so that the reflection from one filament reinforces that of the next.
4. The tape cross section yarn gives a silvery lustre with a soft sheen similar to that exhibited by the diabolo cross-section yarns.

It appeared that the sample with carbon black level of 0.025% was the most attractive for application in the apparel market, as judged by the consensus of a team of experts familiar with apparel and textile fashions.

A further conclusion was that all yarns showed exceptional and attractive softness, especially compared with existing offerings in the market place.

A further conclusion was that the fully drawn yarn sample in each group was not visually different from its POY counterpart of the same cross section and pigment content. All of the yarns exhibited good softness.

It is also to be noted that all yarns had excellent decitex uniformity as evidenced by their U% values.

Example 2

A series of yarn samples was melt spun to investigate different colourants for optimising a gold effect yarn, and especially in resisting migration of the "metallic" colour on to the companion yarn when the two are washed together.

The gold colour was derived by combining yellow, red and black colored masterbatches in a specific recipe. To investigate the color fastness of several candidate masterbatches, a series of yarn samples prepared by blending the masterbatch granules with a cationic dyeable polymer, and melt-spinning the mixture. The colourant was added to the cationic dyeable polymer at a concentration of 0.1 to 0.5%. The resulting yarn samples were assessed for colour fastness with respect to shade change, and also for staining on to a second, undyed nylon yarn, according to the EN ISO 105-CO6:1997 test method.

The characteristic of this test is that it rates both the colour loss from the melt-coloured yarn, and the staining on to a standard control yarn when the two are heated together in a vessel of water. Both colour loss from the one component and staining of the other are visually rated on a scale of 1 to 5, where 5 indicates no change, and 1 is very severe. The best possible score is therefore 5/5.

The data given below in Table 4 show conclusively that insoluble pigments give excellent colour fastness properties whilst soluble dye type pigments give colour fastness properties that at best have borderline acceptability, and a tendency to stain the companion yarn.

TABLE 4

| Coloured masterbatch | Colour type | Shade change | Staining onto nylon |
|---|---|---|---|
| Yellow K-3G | Soluble dye | 4–5 | 3–4 |
| Yellow MP2G | Insoluble pigment | 5 | 5 |
| Yellow MP-RL | Soluble dye | 5 | 4 |
| Yellow 62 | Soluble dye | 4–5 | 3–4 |
| Yellow 2016 | Insoluble pigment | 5 | 5 |
| Red 3025 | Soluble dye | 2–3 | 2–3 |
| Red 63 | Insoluble pigment | 5 | 5 |
| Red 3030 | Insoluble pigment | 5 | 5 |

Conclusion—It is necessary to use insoluble pigments, not water soluble dyes.

Example 3

These experiments were made to determine the efficacy of a cationic dye polymer yarn in accordance with the invention, in resisting staining by anionic dyes. In other words the resistance of the metallic effect yarn to staining when the companion yarn is dyed.

In Example 3A, a spun-coloured "metallic silver" POY test yarn was spun using standard anionic-dyeable polymer This yarn was knitted into a hoseleg consisting of alternate panels of the test yarn, and a standard ecru anionic-dyeable control yarn (45 AEG).

In Example 3B, a spun-coloured "metallic silver" POY test yarn was spun using standard anionic dyeable polymer. This yarn was knitted into a hoseleg with alternate panels of an ecru high anionic dye affinity yarn (AEG 75). This example is therefore very similar to example 3A, except that the companion (control) yarn has a higher amine end group level.

In Example 3C, a spun coloured "metallic silver" POY test yarn was spun, this time using cationic-dyeable (anionic dye resist) polymer but otherwise identical to the first yarn. It too was knitted into a hoseleg with alternate panels of the standard ecru anionic control yarn. This example is identical to Example 3A, except that the "metallic" yarn is now made with cationic dyeable polymer.

In Example 3D, a spun-coloured "metallic silver" POY test yarn was spun, using cationic-dyeable (anionic resist) polymer but otherwise identical to the first yarn. It was knitted into a hoseleg with alternate panels of yarn made from the ecru high anionic dye affinity yarn (AEG 75). The example is therefore identical to example 3C, except that the companion yarn had high affinity for anionic dyes.

For convenience, these combinations are summarised below in Table 5:

TABLE 5

| Example | Metallic Silver Yarn | Companion Ecru Yarn |
|---|---|---|
| 3A | Standard Polymer | Standard polymer |
| 3B | Standard polymer | High anionic affinity |
| 3C | Cationic dyeable polymer | Standard Polymer |
| 3D | Cationic dyeable polymer | High anionic affinity |

The four hoselegs so produced were then dyed under identical conditions, but in separate dye baths, at pH 6 using an anionic dye. Each hoseleg was then assessed visually for staining of the metallic-look by the anionic dye.

The results of the visual assessments are as follows:

The first "metallic" yarn, 3A, made with the standard anionic dyeable polymer showed very intense coloration by the anionic dye, though it had not taken up so much dye as the anionic dyeable control yarn.

The second "metallic" yarn, 3B, made with the standard anionic dyeable polymer also showed strong colouration by the anionic dye, though it had not taken up as much dye as the high anionic dye affinity yarn.

The conclusion to be drawn from examples 3A and 3B is that a spun-coloured yarn made with standard anionionic-dyeable polymer is still strongly coloured by anionic dyestuffs, even in the presence of a companion yarn which might have been expected to compete strongly for the dyestuff.

The third "metallic" yarn, 3C, made with the cationic dyeable polymer showed only a small take up of the anionic dye, with the rest being taken up by the anionic dyeable control yarn. This shows that use of the cationic dyeable polymer confers anionic dye-resist properties on the melt-coloured yarn, though there is still sufficient staining to be troublesome in practice.

The fourth "metallic" yarn, 3D, made with cationic dyeable polymer showed no visible take-up of the anionic dye, with all the dye being taken up by the high anionic dye affinity yarn. This shows that a cat-dye "metallic" yarn can be combined in a fabric with a companion yarn of high affinity for conventional anionic dyes, in a such a way that the the companion yarn is deeply dyed, and the "metallic" yarn is left as an undyed reserve yarn to give metallic highlights.

The specific yarns used in these tests were as follows:

"Metallic" yarn made with standard anionic dyeable polymer—56dtexf26 spun coloured "silver" diabolo cross-section, 40 RV, 45 AEG, 0.025% carbon black.

"Metallic" yarn made with cationic dyeable polymer—56dtexf26 spun coloured "silver", diabolo cross section, 31.5 RV, 41 AEG, 55 SO3H.

Anionic dyeable control yarn—44dtexf34 false-twist textured semidull yarn, RV 40, AEG 45, 0.3% TiO2.

High anionic dye affinity yarn—44dtexf34 false-twist textured fully dull yarn, RV 40, AEG 45, 1.6% TiO2.

For each hoseleg, the competitive dyeings were carried out at pH 6.

The above embodiments have been described by way of example only. Many other examples falling within the scope of the accompanying claims will be apparent to the skilled reader.

What is claimed is:

1. A profiled polyamide yarn having a yarn weight of from about 5 to about 300 dtex, a filament weight of from about 0.5 to about 7 dtex, and a non-circular profiled filament cross-section, wherein the polyamide comprises from about 0.01 to about 3% by weight of a non-white pigment melt-dispersed therein.

2. A polyamide yarn according to claim 1, wherein the yarn is a partially oriented yarn (POY) or a partly drawn or fully drawn (FDY) yarn.

3. A polyamide yarn according to claim 1, wherein the yarn is a low oriented yarn (LOY) that has been further processed by draw twisting or draw winding.

4. A polyamide yarn according to claim 1, wherein the yarn has a titre uniformity in Uster % of less than about 1.5%.

5. A polyamide yarn according to claim 1, wherein the yarn has a titre uniformity in Uster % of less than about 1.0%.

6. A polyamide yarn according to claim 1, wherein the yarn has an elongation to break of from about 20 to about 90%.

7. A polyamide yarn according to claim 1, wherein the yarn has a tenacity of from about 25 to about 70 cN/tex.

8. A polyamide yarn according to claim 1, wherein the filament profile is trilobal.

9. A polyamide yarn according to claim 8, wherein the trilobal filament modification ratio is in the range of from about 1.2 to about 2.4.

10. A polyamide yarn according to claim 9, wherein the trilobal filament modification ratio is in the range of from about 1.4 to about 1.8.

11. A polyamide yarn according to claim 1, wherein the filament cross-section is elongated.

12. A polyamide yarn according to claim 11, wherein the filament cross-section is selected from the group consisting of diabolo, tape and oval.

13. A polyamide yarn according to claim 12, wherein the length ratio of the longest axis of the filament cross-section to the shortest axis at right angles to the longest axis is greater than about 1.5.

14. A polyamide yarn according to claim 1, wherein the non-white pigment is selected from coloured organic or inorganic pigments that are preferably insoluble in water but may be only sparingly soluble in water.

15. A polyamide yarn according to claim 1, wherein the polyamide comprises less than about 0.1% by weight of $TiO_2$.

16. A polyamide yarn according to claim 1, wherein the yarn has been textured.

17. A polyamide yarn according to claim 16, wherein the texturing has been performed by air jet texturing.

18. A polyamide yarn according to claim 1, wherein the polyamide is a cationic dyeable polyamide.

19. A polyamide yarn according to claim 1, wherein the polyamide comprises from about 0.025 to about 2% by weight of a non-white pigment melt-dispersed therein.

20. A fabric comprising a profiled polyamide yarn according to claim 1.

21. A fabric according to claim 20, wherein the fabric further comprises a second yarn having a less reflective appearance than the profiled yarn, whereby the profiled yarn produces highlights in the fabric.

22. A fabric according to claim 21, wherein the second yarn is in a dark colour, or black.

23. A fabric according to claim 20, wherein the profiled yarn is a cationic dyeable polyamide yarn and the second yarn is an anionic dyeable yarn, and said fabric is dyed with an anionic dye.

24. A fabric according to claim 23, wherein the second yarn which has an amine end group (AEG) content greater than about 60 moles per $10^6$ grams.

25. A garment comprising a fabric according to claim 20, wherein the fabric is in a visible part of the garment.

* * * * *